United States Patent [19]

Kuhn

[11] 4,207,701

[45] Jun. 17, 1980

[54] DISMANTLABLE TETHERED TOP WITH REVERSIBLE HALVES

[76] Inventor: Thomas R. Kuhn, 2383 California St., San Francisco, Calif. 94115

[21] Appl. No.: 968,283

[22] Filed: Dec. 11, 1978

[51] Int. Cl.[2] ..... A63H 1/30

[52] U.S. Cl. ..... 46/61

[58] Field of Search ..... 46/61, 60, 48, 49, 50, 46/191

[56] References Cited

U.S. PATENT DOCUMENTS

| | | | |
|---|---|---|---|
| 455,943 | 7/1891 | Hill | 46/191 X |
| 1,806,485 | 5/1931 | Mirafuentes | 46/61 |
| 2,517,849 | 8/1950 | DeVincent et al. | 46/48 |
| 2,891,351 | 6/1959 | Madaras et al. | 46/61 |
| 3,728,813 | 4/1973 | Jolliffe | 46/60 |
| 3,936,974 | 2/1976 | House | 46/61 |

FOREIGN PATENT DOCUMENTS

| | | | |
|---|---|---|---|
| 745712 | 2/1933 | France | 46/61 |

*Primary Examiner*—F. Barry Shay

*Attorney, Agent, or Firm*—Owen, Wickersham & Erickson

[57] ABSTRACT

A tethered top capable of being disassembled by unscrewing of its two body section halves from one another is disclosed. No tools are required to dismantle the tethered top, since a center connector shaft is secured to a pair of end connectors which are keyed into the respective body section halves, with at least one of the end connectors being threadedly connected to the connector shaft. A wooden center shaft or axle member is disposed concentrically on the connector shaft, having an axial bore, and this axle member engages into counterbores at the inner sides of the body section halves. Similar counterbores are located at the outside surface of each half, for receiving the keyed end connectors. Thus, each body section half is reversible, and the tethered top may be assembled in any of three general configurations. The wooden axle member may be removed and replaced when worn out by dismantling the tethered top.

10 Claims, 5 Drawing Figures

DISMANTLABLE TETHERED TOP WITH REVERSIBLE HALVES

BACKGROUND OF THE INVENTION

The invention relates to tethered tops, for example to Yo-Yos, more particularly to a Yo-Yo capable of easy disassembly to replace the wooden center axle or to vary the configuration of the Yo-Yo by reversing the orientation of the two halves.

Yo-Yos having the capability of being dismantled are known. See, for example, U.S. Pats. Nos. 1,419,402; 1,806,485; 2,517,849; 3,233,359; and 3,936,974. Most of these disclosures relate to dismantlable Yo-Yos which require a screw driver or other such tool to remove a fastener associated with the core of the device, whereby the two halves may then be separated. However, the above cited U.S. Pat. No. 1,806,485 to Mirafuentes discloses a music-producing Yo-Yo having a pair of sections which may be dismantled by relative rotation of the two sections, as in the present invention. Mirafuentes includes a center pin or shaft having threads on one end which directly connect with and screw into a threaded socket formed at the center of one of the hollow, cup shaped sections or halves. Concentrically positioned over this center pin are three separate axle sections which provide the necessary separation between the two halves and which support a pair of circular metal discs which relate to the sound-producing function of the toy.

It is apparent that with the Mirafuentes device, it would be possible to replace the center string guide member if desired, by unscrewing the two body section halves from one another and dismantling the center assembly. However, the structure of Mirafuentes is not advantageous to the purposes of the present invention because its interior configuration is directed to the music-producing function and is more complex than that of the presently disclosed Yo-Yo. Also, the manner of connection of the threaded center pin or shaft is different from that of the present invention, having no separate nut members, and the Yo-Yo is not as durable or as attractive in appearance as the Yo-Yo of the present invention described below, nor does it allow for reversibility of Yo-Yo halves. Also, the type of body section halves disclosed in Mirafuentes would require that they be formed of metal or plastic rather than of the popular and classic hardwood.

SUMMARY OF THE INVENTION

The Yo-Yo of the present invention provides a novel assembly configuration which not only permits the wooden center axle, including the string guide, to be removed and replaced by a simple disassembly, without tools, but which also results in a very pleasing external appearance, produces a very strong and durable assembly, and additionally permits the configuration of the Yo-Yo to be varied—i.e., each of the two body section halves may be oriented in either direction, producing at least three different configurations. This is accomplished by the use of a metal center connector shaft which has fasteners on each end, at least one of which is threadedly connected to the connector shaft and removable by unscrewing. Each of the end connectors is keyed into the outer portion of a bore through the associated body section of the Yo-Yo. Inside, at the center of the connector shaft, is a center axle and string guide, preferably of wood, which has a central axial bore and is positioned concentrically over the connector shaft. The end connectors, at least one of which is actually a nut member for engagement with the threaded connector shaft, are of any desirable attractive shape such as hexagonal, square, etc. and are fitted into similarly shaped recesses at the outside of the bores through the body section halves. Thus, when the body section halves are rotated relative to one another in an unscrewing direction, one of the end connectors becomes disengaged from the connector shaft and the other remains seated in the other body section, but may easily be removed if desired. The wooden center axle may be removed by sliding it off the connector shaft and thus may be replaced if desired.

So that the orientation of the body section halves may be reversed to result in Yo-Yos of various configurations, each body section half preferably includes identical keyed counterbores at each of its faces. Thus, for each body section half, the keyed end connector seats in the outer recess, while the wooden axle member resides in the inner such counterbore, and the respective positions are reversible. The result is that the Yo-Yo can be assembled in a classic, traditional configuration; in a "butterfly" configuration with the larger-diameter side of each half outward; or in a "pagoda" configuration, with both halves facing the same direction.

Each counterbore may be slightly tapered, and the wooden center axle may be similarly tapered, so that a tight fit results, and the end connectors may be similarly tapered if desired, but in any event the keyed portion at the outer end of each end connector will seat properly for a secure connection, regardless of tapering.

Accordingly, a dismantlable Yo-Yo according to one embodiment of the invention comprises a pair of body sections, each having an axial bore through its center, and including counterbores; center shaft means positioned in the body section bores, including a central string guide disposed between the body sections in the assembled Yo-Yo; a pair of fastener means, one connected to each end of the center shaft means and removably retained in the counterbore of the body section bore, with at least one of the fastener means being threaded to and unscrewable from the center shaft means; and means associated with the fastener means and with the body section bores for preventing rotation of each fastener means with respect to the associated body section, so that the Yo-Yo may be dismantled easily by relative rotation of the two body sections, which is effective to disconnect one of the fastener means and the associated body section from the center shaft means, so that the two body sections may be separated and the center shaft means may be removed and replaced if desired.

It is therefore among the objects of the invention to provide a unique dismantlable Yo-Yo having the capability of including a wooden center axle member and wooden body sections if desired, while also being sound and durable in construction and affording the several additional advantages discussed above and below. This and other objects, advantages and features of the invention will be apparent from the following description of a preferred embodiment of the Yo-Yo taken in conjunction with the accompanying drawing.

DESCRIPTION OF A PREFERRED EMBODIMENT

Figure 1:
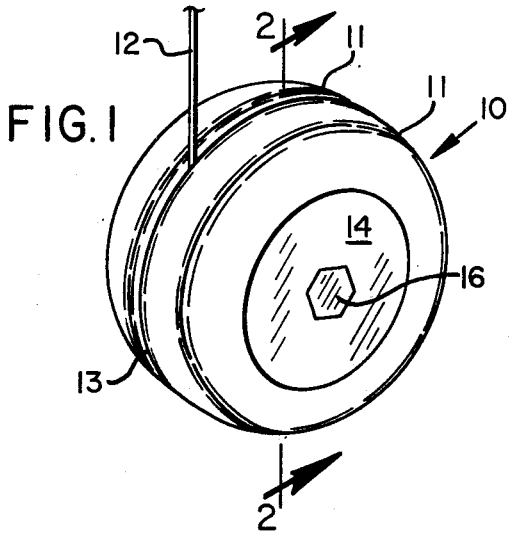
FIG. 1 is a perspective view showing a Yo-Yo according to the invention, suspended by a string in the usual manner.
Figure 2:
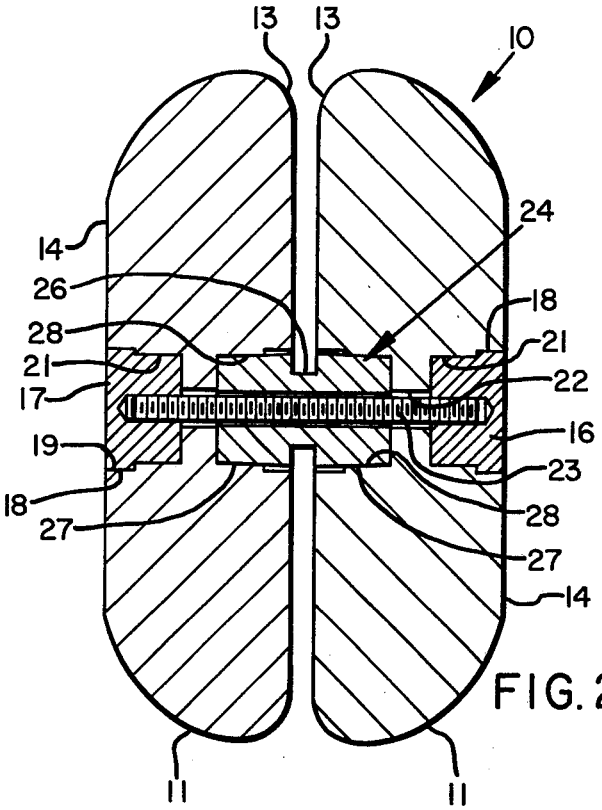
FIG. 2 is a sectional view of the assembled Yo-Yo, taken along the line 2—2 of FIG. 1.

In the drawings, FIG. 1 shows a Yo-Yo 10 constructed in accordance with the principles of the invention. It includes a pair of body section halves 11 and is supported in the usual winding and unwinding relationship on a string 12. The two halves 11 are preferably, but not necessarily, of the classic shape, each having a larger-diameter side 13, flat on its inner side, and curving down to a flat smaller-diameter side 14, as shown in FIGS. 1 and 2. FIG. 1 also shows a keyed end connector 16, which seats into a counterbore of the body section and may comprise a nut member, as further explained below.

Figure 3:
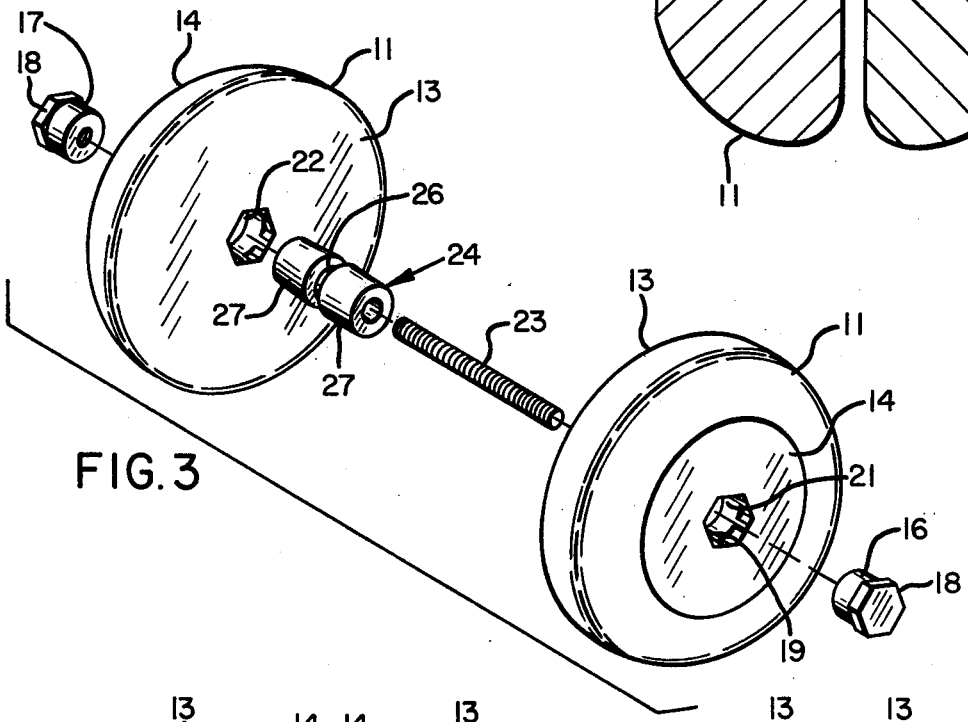
FIG. 3 is an exploded perspective view indicating the manner of assembly and the structural makeup of the Yo-Yo.

FIGS. 2 and 3 show the internal structure and manner of assembly of the Yo-Yo 10. The end connector 16, matched by a similar connector 17 at the other end of the Yo-Yo, has an outer keyed portion 18 which seats in a similarly-shaped recess 19 which forms the outer portion of a counterbore 21. The counterbore 21 is part of a central axial bore 22 which passes through each body section half 10. Between the two end connectors 16 and 17, and secured to both of them in the assembled Yo-Yo, is a connector rod or shaft 23 which may be threaded throughout its length, as indicated, and screwed onto both end connectors. However, the rod 23 may alternately be permanently secured to the end connector 17 and threaded only at the end which threadedly engages the other end connector 16. This would result in the same manner of assembly, operation and durability as the arrangement illustrated.

Concentrically positioned on the connector rod 23 is a center shaft or axle member 24, which is generally cylindrical and has a central groove or string receiving area 26, which may be of reduced diameter, as shown. As indicated, the groove 26 is prefereably of a width substantially equal to the spacing between the Yo-Yo halves 11 in the assembled configuration, so that the string is guided in a uniform deep groove between the halves 11. The desired diameter for the string receiving area 26 may be provided by the reduced diameter indicated, or simply by sizing the whole axle member 24 at the desired string groove diameter.

The center axle 24 established the spacing between the two body section halves. Its two end portions 27 reside in counterbores 28 in the larger-diameter sides 13 of the body section halves, and abut against the inside boundaries of these counterbores as indicated. The connector rod 23 pulls the two halves 11 tightly against this center axle 24 as is readily seen from the drawings.

Although the body section halves 11 may be of any desired material, such as wood, metal or plastic, they are preferably of wood, the material of which Yo-Yos have classically been made. One advantage of the present invention is that it enables a take-apart Yo-Yo to be made efficiently of wood, in contrast to many prior art Yo-Yos capable of disassembly. Wood is much preferred by most Yo-Yo fanciers, and the construction illustrated herein accomplishes the provision of a classically-designed hardwood Yo-Yo with previously unavailable unique functional advantages.

Similarly, the center axle 24 may be made of metal or plastic, but hardwood is much preferred. The desired "feel" of the classic Yo-Yo, and the "sleeping" characteristics desired by most users, are achieved through the use of a hardwood axle. This is another important advantage of the Yo-Yo construction of the invention—the body section halves 11 may be of any desired material, while still allowing the center axle 24 to be of wood, and replaceable. The replacement capability is significant because the groove 26 of the wooden axle eventually becomes weakened by repeated frictional heating and eventual scorching, and finally cracks or otherwise disintegrates, or loses its desirable "sleeping" characteristics. It may be replaced by a simple dissassembly and re-assembly with a new center axle.

Figure 4:
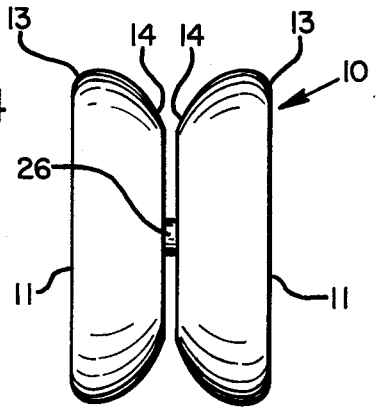
FIG. 4 is an elevational view showing an alternate configuration for assembly of the two body section halves of the Yo-Yo.
Figure 5:
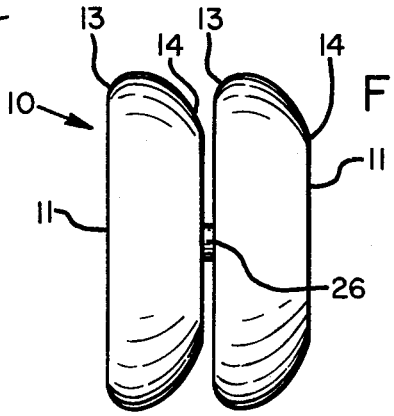
FIG. 5 is another elevational view indicating a third manner of assembly of the Yo-Yo.

Another important feature of the invention relates to universality and reversibility of the body section halves 11. On each half 11, the counterbore 21 in the smaller-diameter face 14 is preferably identical to the counterbore 28 in the larger-diameter face 13. Each is shaped to receive an end connector 16 or 17 in keyed relationship, via the outer recess 18, or to receive an end of the center axle 24, as shown. Therefore, either or both halves may be reversed in orientation as indicated in FIGS. 4 and 5. FIG. 4 shows the Yo-Yo with both halves 11 reversed, forming a "butterfly" configuration. FIG. 5 shows just one half reversed, forming a "pagoda" configuration. The classic configuration is of course shown in FIGS. 1, 2 and 3. Thus, three different configurations and appearances are possible as illustrated, and there are technically four, as if the halves shown in FIG. 5 were reversed in position, but not in orientation. This may be significant if different decorative inscriptions or designs are included on the four faces.

The above described preferred embodiment provides a unique take-apart Yo-Yo which may be made of hardwood and may include a replaceable hardwood center axle, while also being assemblable into various different configurations and being soundly and durably constructed. Various other embodiments and variations to this preferred embodiment will be apparent to those skilled in the art and may be made without departing from the spirit and scope of the following claims.

I claim:

1. A dismantable tethered top comprising:

a pair of similar body section halves, each having a central axial bore;

a wooden center shaft having an axial bore, said shaft including a center string receiving area;

a connector shaft passing through the bore of the wooden shaft;

an end connector at each end of the connector shaft, at least one end connector being threaded to and removable from an end of the connector shaft;

each body section half having similar counterbores in each side, size to receive an end connector;

key means associated with each counterbore and with the end connectors for preventing rotation of each end connectors with respect to the associated body section half;

said wooden center shaft having ends sized to fit into any of the counterbores; and said tethered top being assembled with the ends of the wooden center shaft engaged in inwardly-facing counterbores of the two body section halves, with the connector shaft extending through the wooden shaft and into each body section half, said end connectors being secured to the ends of the connector shaft and keyed into the outer counterbores of the halves, whereby the tethered top is securely held together, and may be dismantled by relative rotation of the two body section halves, which is effective to unscrew and disengage one end connector from the connector shaft, permitting the separation of the two halves and the removal of the wooden center shaft for replacement, and whereby the tethered top may be assembled in various configurations with either body section half facing in either direction.

2. The tethered top of claim 1 wherein the connector shaft is threaded of both ends, and both end connectors are removable from the connector shaft by unscrewing.

3. The tethered top of claim 1 wherein said key means comprises a shaped noncircular head at the outer end of each end connector, and a similarly shaped recess in the outer portion of each counterbore.

4. The tethered top of claim 1 wherein the center string guide of the wooden center shaft is recessed to a smaller diameter, with a width substantially the same as the spacing between the body section halves in the assembled tethered top.

5. A tethered top capable of being disassembled, comprising:

a pair of body sections, each having an axial bore through its center, said bores including similar counterbores in each side of each body section;

center shaft means positioned in the body section bores, including a central string guide disposed between the body sections in the assembled tethered top;

a pair of fastener means, one connected to each end of the center shaft means and removably retained in the counterbore of the body section bore, at least one of said fastener means being threaded to and unscrewable from the center shaft means; and means associated with the fastener means and with the body section bores for preventing rotation of each fastener means with respect to the associated body section;

whereby the tethered top may be dismantled by relative rotation of the two body sections, which is effective to disconnect said one fastener means and the associated body section from the center shaft means, so that the two body sections may be separated and the center shaft means may be removed and replaced if desired and so that the tethered top may be assembled with either body section facing in either direction.

6. The tethered top of claim 5 wherein said rotation-preventing means comprises a shaped noncircular head at the outer end of each fastener means and a similarly shaped recess in the outer portion of each counterbore of the body sections.

7. A tethered top capable of being disassembled, comprising:

a pair of body sections, each having an axial bore through its center, said bores including counterbores;

center shaft means positioned in the body section bores, including a central string guide disposed between the body sections in the assembled tethered top;

a pair of fastener means, one connected to each end of the center shaft means and removably retained in the counterbore of the body section bore, at least one of said fastener means being threaded to and unscrewable from the center shaft means; and rotation-preventing means including a shaped noncircular head at the outer end of each fastener means and a similarly shaped recess in the outer portion of each counterbore of the body section, either of said fastener means being adapted to fit in either of said counterbores;

whereby the tethered top may be dismantled by relative rotation of the two body sections, which is effective to disconnect said one fastener means and the associated body section from the center shaft means, so that two body sections may be separated and the center shaft means may be removed and replaced if desired.

8. The tethered top of claim 7 wherein said center shaft means comprises a connector rod having at least one threaded end and a center axle having an axial bore through which the rod passes, said one threaded end being threadedly engaged with one of said fastener means, and the other end of the rod being secured to the other fastener means.

9. The tethered top of claim 8 wherein the center axle is wood.

10. The tethered top of claim 7 wherein each body section has similar counterbores in each of its two sides, whereby the tethered top may be assembled with either body section facing either direction, so that various configurations are possible.

* * * * *